US006648386B2

(12) United States Patent
Rheinhardt

(10) Patent No.: US 6,648,386 B2
(45) Date of Patent: Nov. 18, 2003

(54) REFUSE BAG HOLDER

(76) Inventor: Beverly J. Rheinhardt, 4150 W. Old Father Pl., Tucson, AZ (US) 85741

( * ) Notice: Subject to any disclaimer, the term of this patent is extended or adjusted under 35 U.S.C. 154(b) by 0 days.

(21) Appl. No.: 10/136,557

(22) Filed: May 1, 2002

(65) Prior Publication Data

US 2003/0111853 A1 Jun. 19, 2003

Related U.S. Application Data

(60) Provisional application No. 60/339,029, filed on Dec. 12, 2001.

(51) Int. Cl.[7] ..... B65B 67/12
(52) U.S. Cl. ..... 294/1.1; 248/99
(58) Field of Search ..... 294/1.1, 1.3, 1.4, 294/55, 60; 15/257.1, 257.3; 248/95, 99, 97, 101; D34/5, 6; 141/314, 316; 256/32, 35, 48; 403/99, 102, 206, 209, 220, 223

(56) References Cited

U.S. PATENT DOCUMENTS

| | | | | | |
|---|---|---|---|---|---|
| 310,210 | A | * | 1/1885 | Liedel | 248/97 |
| 558,531 | A | * | 4/1896 | Tarr | 248/99 |
| 875,847 | A | * | 1/1908 | Peterson et al. | 248/97 |
| 972,870 | A | * | 10/1910 | Kandlbinder | 248/99 |
| 1,235,388 | A | * | 7/1917 | Sherwood | 248/101 |
| 1,996,303 | A | * | 4/1935 | McConnell | 248/99 |
| 3,532,314 | A | * | 10/1970 | Vosbikian | 248/97 |
| 3,679,160 | A | * | 7/1972 | Ballenger | 248/97 |
| 3,733,099 | A | * | 5/1973 | Szita | 294/55 |
| 3,747,653 | A | * | 7/1973 | Ringer | 383/12 |
| 3,796,402 | A | * | 3/1974 | Trotta | 248/97 |
| 3,866,872 | A | * | 2/1975 | Burgess | 248/97 |
| 4,312,489 | A | * | 1/1982 | Paetzold | 248/97 |
| 4,319,726 | A | * | 3/1982 | Andersson | 248/97 |
| 4,358,083 | A | * | 11/1982 | Haubrich | 248/100 |
| 4,548,372 | A | * | 10/1985 | Lutzker | 248/99 |
| 4,702,445 | A | * | 10/1987 | Ivory | 248/97 |
| 4,708,307 | A | * | 11/1987 | Daigle | 248/97 |
| D299,574 | S | * | 1/1989 | Savicki | D34/6 |
| 4,856,740 | A | * | 8/1989 | MacLeod et al. | 248/97 |
| 4,940,201 | A | * | 7/1990 | Kurth | 248/101 |
| D318,940 | S | * | 8/1991 | McIntyre | D34/6 |
| D326,752 | S | * | 6/1992 | Griggs | D34/5 |
| 5,139,219 | A | * | 8/1992 | Navarro | 248/97 |
| 6,202,709 | B1 | * | 3/2001 | Wymer | 248/99 |
| 6,330,990 | B1 | * | 12/2001 | Haubrich | 248/99 |
| 6,450,460 | B1 | * | 9/2002 | Trahan et al. | 248/97 |
| 6,511,110 | B2 | * | 1/2003 | Roye | 294/1.1 |
| 2002/0021012 | A1 | * | 2/2002 | Roye | 294/1.1 |

FOREIGN PATENT DOCUMENTS

| | | | |
|---|---|---|---|
| CH | 587752 | * | 5/1977 |
| GB | 2214890 | * | 9/1989 |

OTHER PUBLICATIONS

United States Patent No. 4,962,956, entitled "Waste Collection Device" issued to Scripter on Oct. 15, 1990.
United States Patent No. 4,457,549, entitled "Bag Mouth Holder" issued to Lowery on Jul. 3, 1984.
United States Patent No. 4,222,597, entitled, "Refuse Collecting Device" issued to Willis on Sep. 16, 1980.

(List continued on next page.)

*Primary Examiner*—Dean J. Kramer
*Assistant Examiner*—Paul T. Chin
(74) *Attorney, Agent, or Firm*—Mark Ogram

(57) ABSTRACT

A refuse bag holder having a central pole is adapted to be inserted into the ground. Connectable to the central pole is a loop. In the preferred embodiment the loop is made of three generally linear rigid members which are flexibly connected to each other such that, when the the rigid members are connected to the central pole, the formed loop extends at an upward angle from the pole. The loop, and in some embodiments, a handle on the central pole, form the basis for securing the refuse bag so that it is kept open for easy use.

17 Claims, 4 Drawing Sheets

OTHER PUBLICATIONS

United States Patent No. 4,349,224, entitled, "Animal Waste Collecting and Disposing Apparatus" issued to Shiozaki on Sep. 14, 1982.

United States Patent No. 3,711,141, entitled "Bag Holder" issued to Soergel on Jan. 16, 1973.

United States Patent No. 4,159,139, entitled, "Device for Holding Flexible Bags such as Plastic Trash Bags and the Like" issued to Gawedzinski on Jun. 26, 1979.

United States Patent No. 1,266,522, entitled "Street Cleaning Utensil" issued to Oldham on May 14, 1918.

United States Patent No. Des 285,012, entitled "Refuse Collecting Device" issued to Willis on Aug. 5, 1986.

United States Patent No. 4,048,691, entitled "Trash Sack Support" issued to Spangler on Sep. 20, 1977.

United States Patent No. 6,131,861, issued on Oct. 17, 2000, to Fortier, Jr. et al, and entitled, "Bag Holder".

United States Patent No. 6,164,607, issued on Dec. 26, 2000, to Hawkes and entitled, "Adjustable Portable Bag Holder".

United States Patent No. US D437,668 S, issued on Feb. 13, 2001, to Sanka and entitled, "Frame for a Trash Bag or the Like".

United States Patent No. 6,293,505 B1, issued on Sep. 25, 2001, to Fan and entitled, "Wide Opening Leaves Bagger".

United States Patent No. 6,296,212 B1, issued on Oct. 2, 2001, to Monahan and entitled, "Bag Support"; and.

United States Patent No., 6,315,143, issued Nov. 13, 2001, to Dotts and entitled, "Disposable Standing Trash Bag".

* cited by examiner

FIG. 2
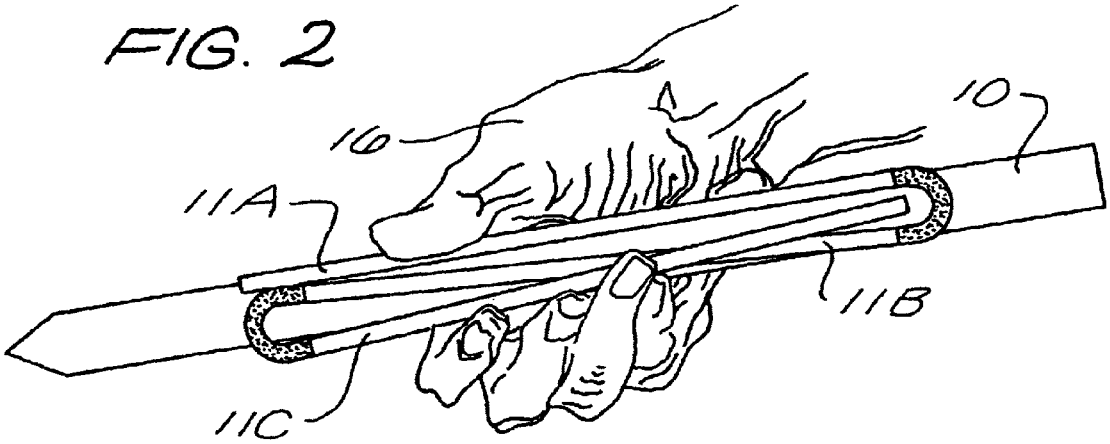
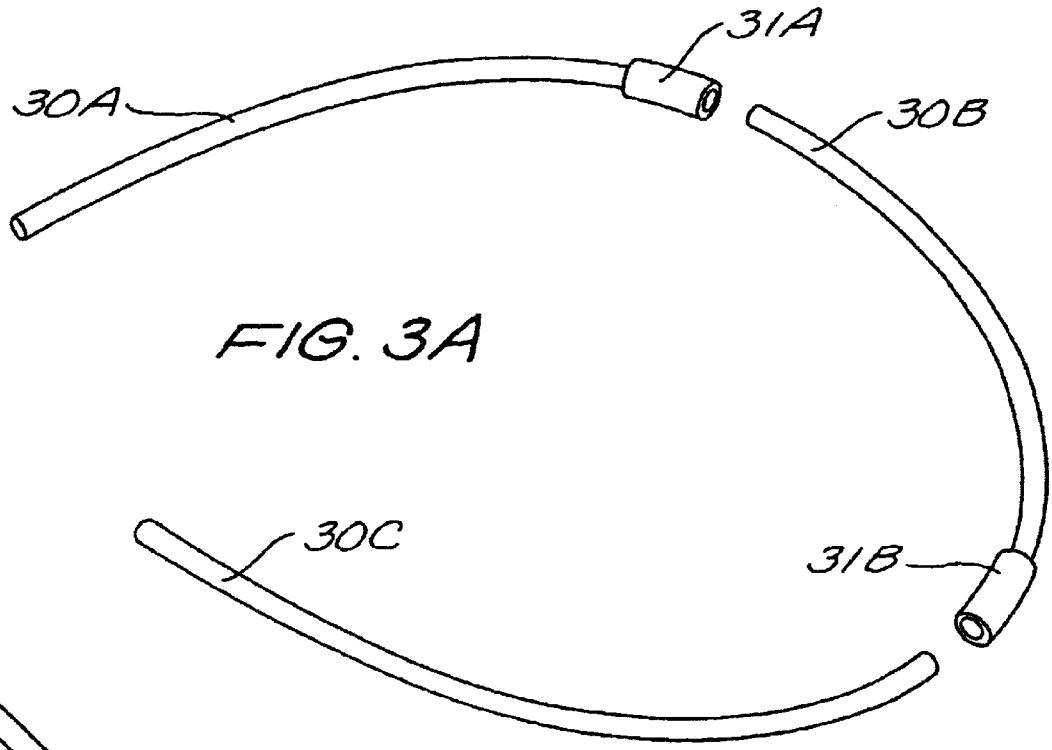
FIG. 3A
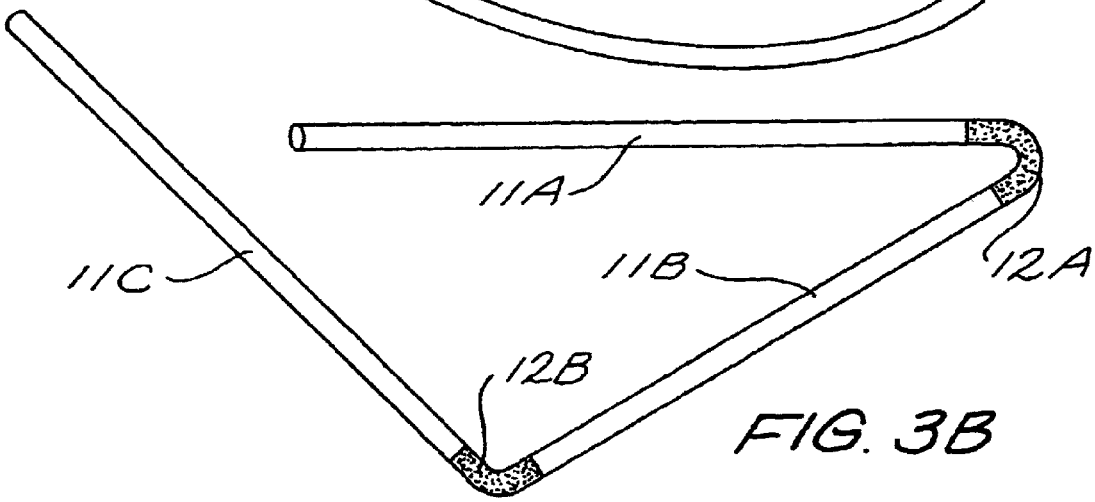
FIG. 3B

REFUSE BAG HOLDER

Priority for this application is claimed from U.S. Provisional patent application Ser. No. 60/339,029, filed on Dec. 12, 2001, and entitled "Trash Bag Holder".

BACKGROUND OF THE INVENTION

This invention relates generally to trash bag receptacles and more particularly to portable holders for trash/refuse bags.

The plastic trash/refuse bag has become an ubiquitous item within commercial settings, the household, and the yard. The low cost for the bag with its small size for storage until use, when combined with its ease of disposal has made the plastic garbage bag universally accepted.

The problem with the flexible bag, as opposed to the rigid trash receptacles, is the loading of the bag itself with leaves or garbage. While the flexibility of the bag makes it easy to store and transport, this very attribute makes it difficult for a single person to load the bag.

To address this problem, there have been a variety of mechanisms developed. Some of these are described in: U.S. Pat. No. 4,962,956, issued to Scripter on Oct. 16, 1990, and entitled, "Waste Collection Device"; U.S. Pat. No. 4,457,549, issued on Jul. 3, 1984, to Lowery and entitled, "Bag Mouth Holder"; and U.S. Pat. No. 4,222,597, issued to Willis on Sep. 16, 1980, and entitled, "Refuse Collecting Device". While these approaches have assisted to some degree, the solutions themselves are bulky and difficult to use as portable apparatus.

It is clear there is a need for an improved portable refuse bag holder.

SUMMARY OF THE INVENTION

The present invention provides a refuse bag holder. Within this context the present invention relates to plastic garbage or refuse bags; but, the invention is also useful for other types of flexible bags.

Within the preferred embodiment, the invention uses a central pole which is adapted to be inserted into the ground. The central pole has a bottom end sharpened or pointed to assist in the insertion of the pole into the ground. The preferred embodiment uses a wooden pole; those of ordinary skill in the art readily recognize other materials which will serve in this capacity, such as but not limited to, aluminum.

In some embodiments of the invention, a step bar is mounted onto the central pole. The step bar permits the user to press downward with his foot to force the central bar into the ground. Ideally the step bar is spring mounted and is pulled out of the way (against the pole) when the step bar is not in use.

Connectable to the central pole is a loop. The loop is bowed during attachment to the central pole. This bowing of the loop, creates a firm bond between the loop and the central pole when the loop is allowed to "spring back".

When the loop is attached to the central pole, it creates a framework through which the plastic garbage/refuse bag is inserted. With the refuse bag folded over the corners of the bowed frame and the top of the central pole, a spring action is created to firmly secure the refuse bag. Once so installed, the mouth of the plastic bag is kept open; and when the central pole is inserted into the ground, the bag's mouth is properly positioned to serve as a portable garbage receptacle.

When the loop is connected to the central pole (and after the plastic bag has been secured to the assemblage), and when the pole hasn't been inserted into the ground, the central pole serves as an easy handle for the user to carry and transport the now-open-mouthed plastic bag. In this manner, the user is able to transport the bag to a site and with one hand holding the bag assembly with the bag's mouth opened, easily place litter, leaves, and other debris into the plastic bag.

When the bag is full, it is easily removed from the loop.

Since the loop is disconnectable from the central pole, ideally the loop is collapsible for easy transportation and storage. This allows the entire mechanism, together with a supply of plastic garbage/refuse bags to be easily transported and used.

In the preferred embodiment, the loop is made of three generally linear rigid members which are flexibly connected to each other. These three rigid members, while collapsing on each other during transport, form the loop for holding the plastic bag.

Ideally, these three rigid members are connected to the central pole at an upward angle from the pole. This arrangement provides for added connection between the loop and the plastic bag to prevent slippage during the loading of the bag with debris.

The invention, together with various embodiments thereof, will be more fully explained by the accompanying drawings and the following explanation.

DRAWINGS IN BRIEF

FIG. 2 is a side view of the disassembled preferred embodiment showing its easy transportation.

FIGS. 3A and 3B illustrate two embodiments of the loop.

Figure 5A:
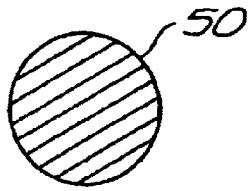
Figure 5B:
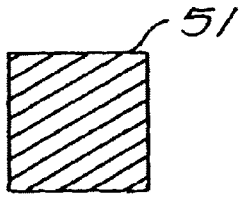
Figure 5C:
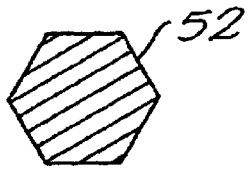

FIGS. 5A, 5B, and 5C are cross-sectional views of various embodiments of the central pole.

Figure 6:
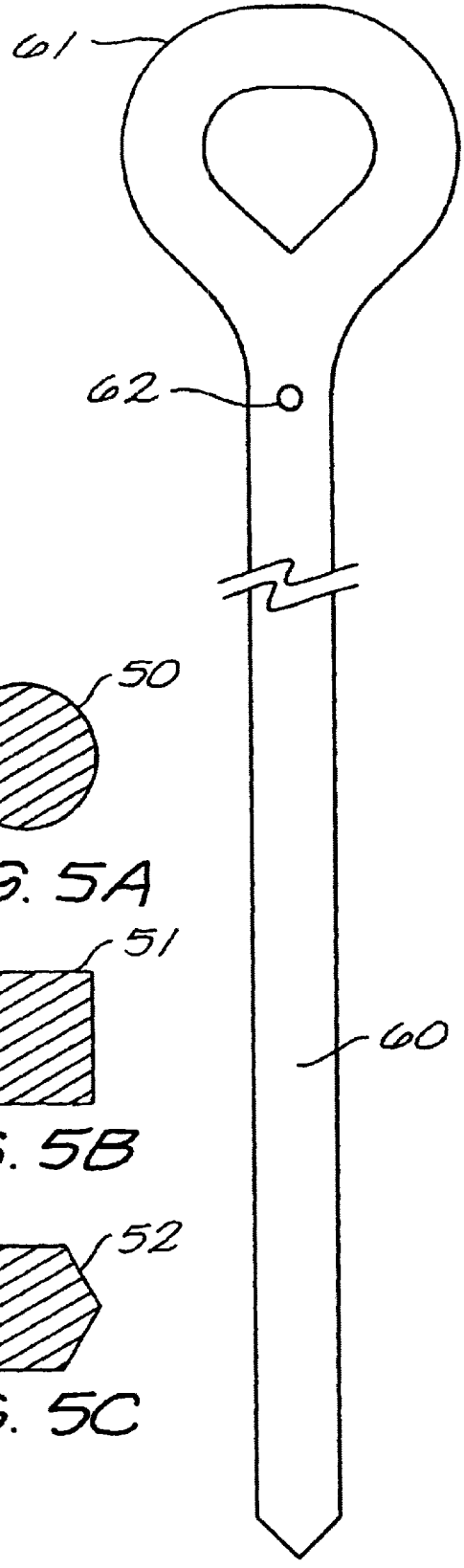

FIG. 6 is a side view of an embodiment of the central pole having a handle at an upper end thereof.

Figure 7A:
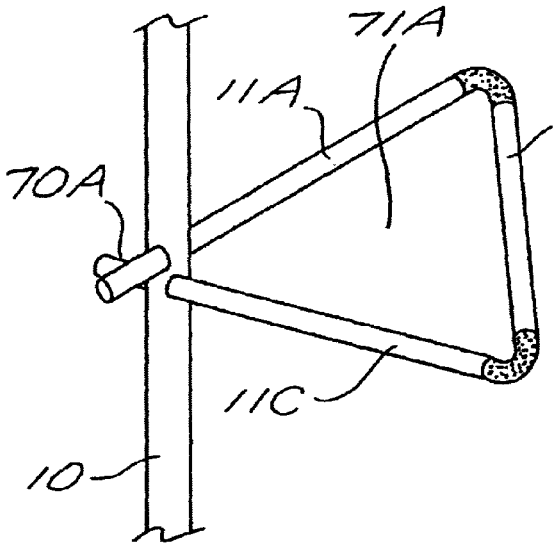
Figure 7B:
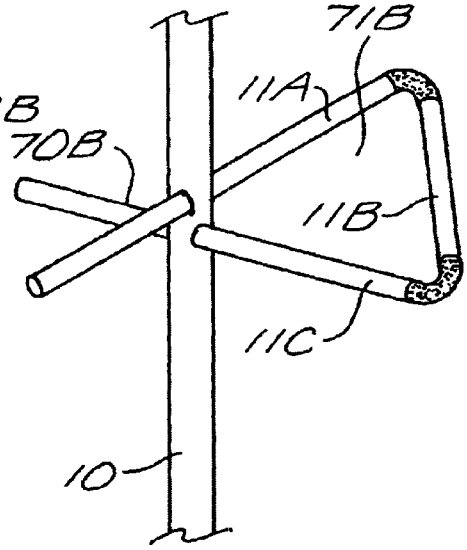

FIGS. 7A and 7B illustrate the preferred embodiment showing how the circumference of the loop is adjusted to address differing sizes of refuse bags.

Figure 8:
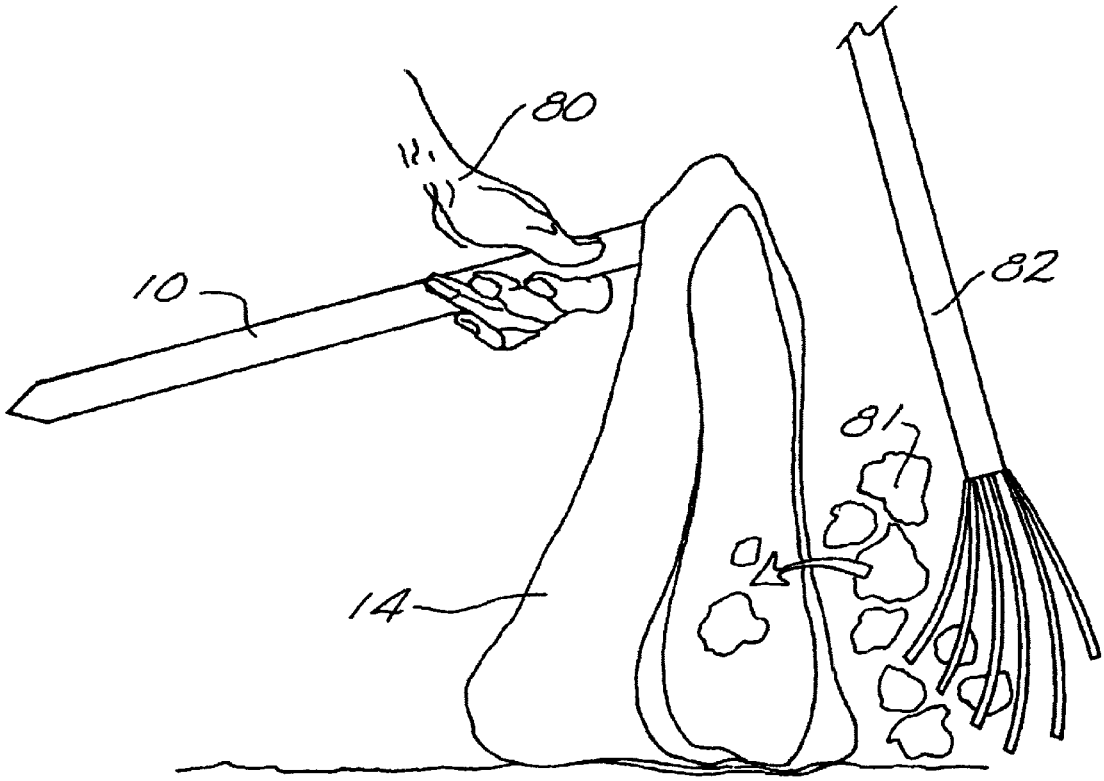

FIG. 8 illustrates the use of the present invention to collect grass and other debris.

DRAWINGS IN DETAIL

FIGS. 1A, 1B, 1C and 1D are side views showing the assembly steps of the preferred embodiment.

Figure 1A:
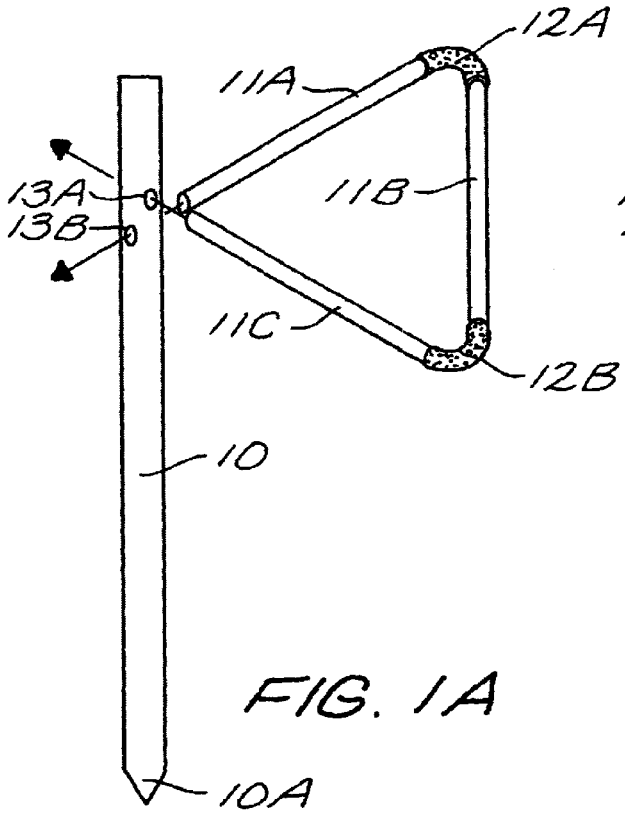
FIGS. 1A, 1B, 1C and 1D are side views showing the assembly steps of the preferred embodiment.

The assembly of this embodiment is illustrated in FIG. 1A. Central pole 10 has two holes 13A and 13B therethrough. One end 10A, of central pole 10, is pointed to allow central pole 10 to be easily inserted into the soil.

A loop is formed by linear members 11A, 11B, and 11C. Linear members 11A, 11B, and 11C are connected to each other using a flexible mechanism (12A and 12B) providing a hinging arrangement between the three linear members.

During assembly, linear members 11A and 11C are bowed to allow the free ends of linear members 11A and 11C to be inserted into holes 13A and 13B respectively, as shown in FIG. 11B. Once inserted, linear members 11A and 11C are released, and they attempt to straighten thereby forcing linear members 11A and 11B against holes 13A and 13B respectively. This frictional force between the linear members and the holes firmly secures the components; thereby eliminating any need for clips, screws, bolts, or other fasteners.

Ideally holes 13A and 13B are substantially at right angles to each other.

Figure 1B:
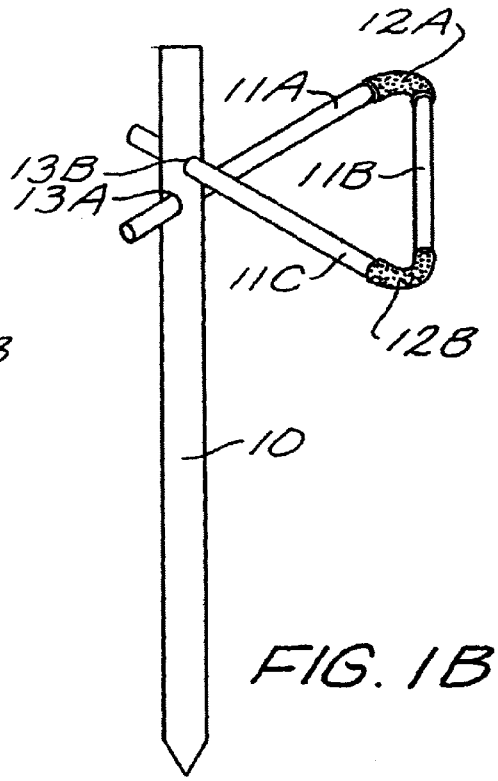
Figure 1C:
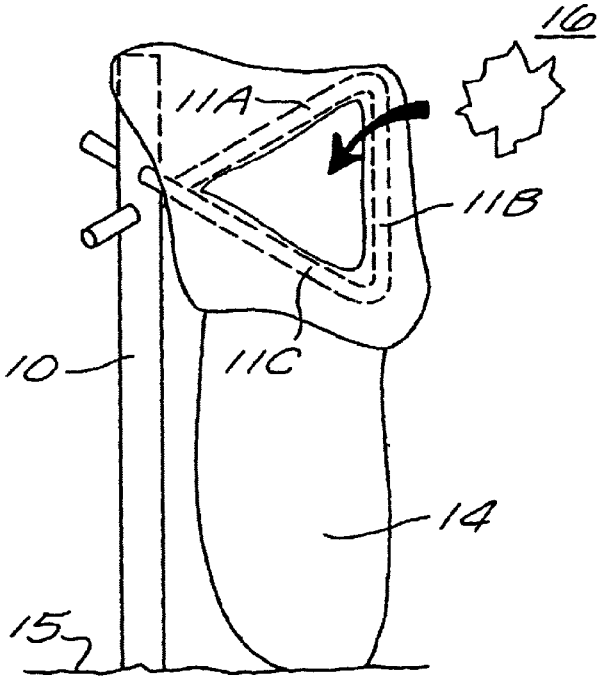

Central pole 10 (either before insertion of linear member 11A and 11C or prior thereto) is inserted into the ground; thereby providing a holder for trash bag 14 (as illustrated in FIG. 1C). The loop formed by linear members 11A, 11B, and 11C maintains the mouth of trash bag 14 open; thereby allowing user 16 to easily deposit refuse thereinto.

Figure 1D:
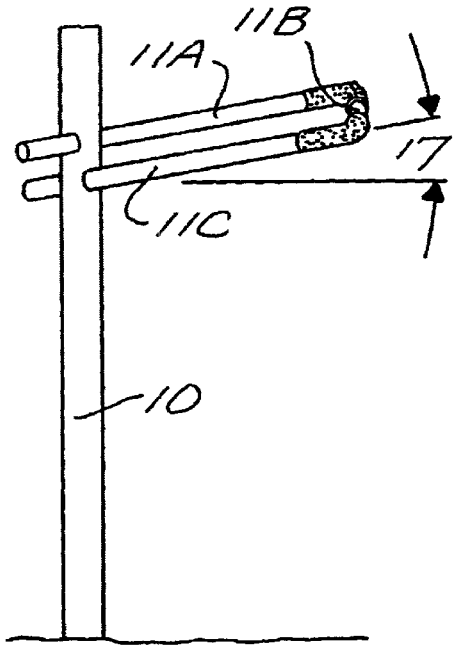

The perspectives provided by FIGS. 1A, 1B, and 1C are chosen to provide for optimal illustrative purposes; but, as shown in FIG. 1D, the loop formed by members 11A, 11B, and 11C, relative to central pole 10, is at an upward slope 17. In the preferred embodiment, upward slope 17 is approximately ten degrees. This upward slope 17 provides for a more secure mounting between garbage bag 14 and the frame illustrated.

FIG. 2 is a side view of the disassembled preferred embodiment showing its easy transportation.

In a disassembled state, as shown in this figure, operator 16 is easily able to grasp and transport the frame since all of the parts (central pole 10 and members 11A, 11B, and 11C) are linear in nature.

FIGS. 3A and 3B illustrate two embodiments of the loop.

The loop assembly of FIG. 3A has three components 30A, 30B, and 30C which are connectable to each other using connectors 31A and 31B. Note, in the loop of this figure, components 30A, 30B, and 30C have a slight curvature[s] to provide for, when assembled, a "rounded" loop.

The loop of FIG. 3B is fully connected. Rod members 11a, 11B, and 11C are held to each other by flexible connections 12A and 12B. In the preferred embodiment, flexible connections 12A and 12B are plastic tubings (alternatively flexible or rubber tubings) secured to the ends of rods 11A, 11B, and 11C. When the user receives the loop of this figure, hinge connectors 12A and 12B are already permanently connected to the rods.

Figure 4:
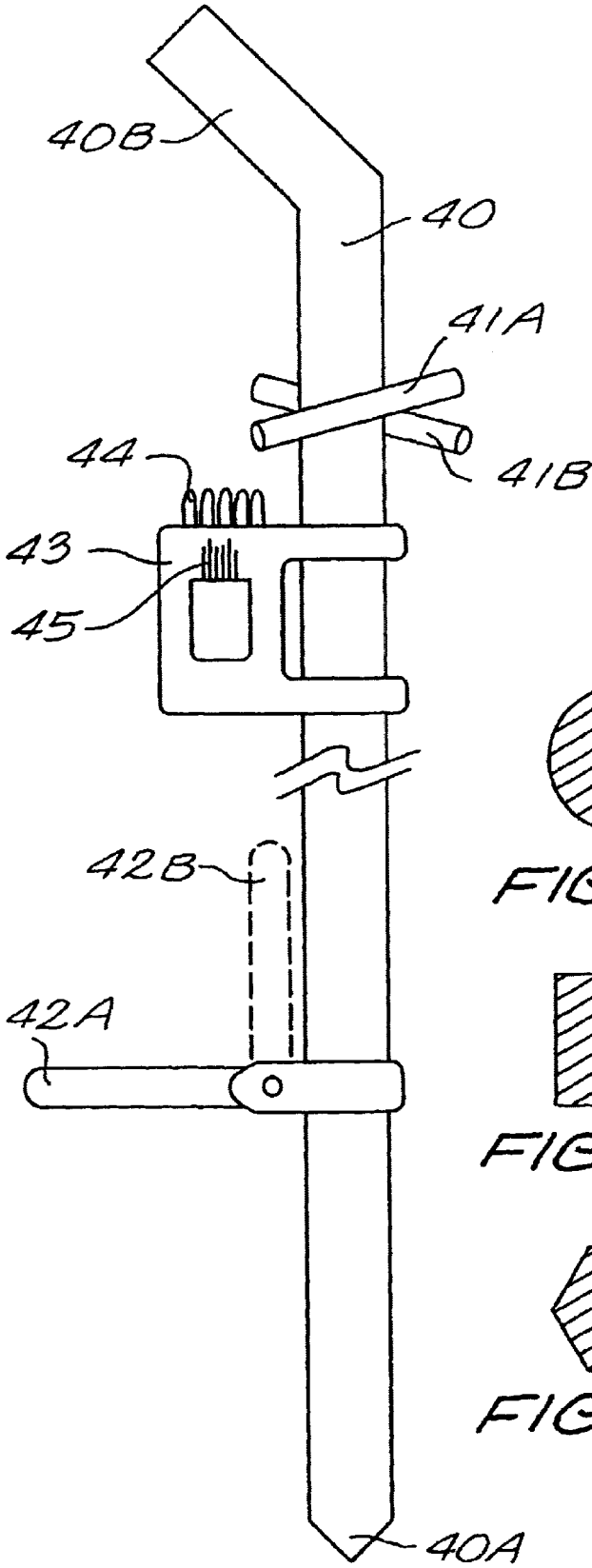
FIG. 4 is a side view of an alternative embodiment of the invention.

FIG. 4 is a side view of an alternative embodiment of the invention.

In this embodiment, pole 40 has handle 40B at one end and an insertion point 40A at the other. Mounted to central pole 40 are attachment mechanisms 41A and 41B which accept the ends of the loop (not shown in this illustration). In this embodiment, attachment mechanisms 41A and 41B are metal tubes which are secured at the appropriate angles to central pole 40.

Positioned on a lower portion of central pole 40 is step 42A which allows the user to drive insertion point 40A into the soil using foot pressure. When step 42A is not in use, a spring withdraws the step to the position shown in 42B.

Positioned at an upper portion of central pole 40 is holder 43 which holds a supply of garbage bags 44 together with ties 43. This provides a handy source of replacement bags and ties.

FIGS. 5A, 5B, and 5C are cross-sectional views of various embodiments of the central pole.

As illustrated, a variety of shapes are available for the central pole, including round, 50, square 51 and hexagonal 52.

FIG. 6 is a side view of an embodiment of the central pole having a handle at an upper end thereof.

The embodiment of FIG. 6 is designed to serve as a cane or walking stick. Pole 60 has handle 61 thereon. Hole 62 (together with a matching hole not shown in this angle) allows the loop (also not shown) to be secured thereto.

FIGS. 7A and 7B illustrate the preferred embodiment showing how the circumference of the loop is adjusted to address differing size of refuse bags.

In FIG. 7A, loop 71A is formed by members 11A, 11B, and 11C which are inserted through central pole 10 allowing ends 70A to extend a selected distance. The distance ends 70A extend past pole 10 defines the size of loop 71A.

In FIG. 7B, ends 70B extend further through central pole 10; hence, loop 71B is smaller.

This attribute of the present invention permits the loop's circumference to be adjusted; thereby addressing the size of garbage bags being used at that instant.

FIG. 8 illustrates the use of the present invention to collect grass and other debris.

User 80 holds central pole 10 so that the mouth of bag 14 is positioned on the ground; thereby allowing rake/broom 82 to easily sweep debris 81 into bag 14.

It is clear that the present invention provides for an improved portable refuse bag holder.

What is claimed is:

1. A refuse bag holder comprising:

a) a central pole adapted to be inserted into the ground and having a first and a second securing mechanism secured thereto; and, b) a loop having, 1) first, second, and third rigid members, 2) wherein, A) said first rigid member is flexibly connected at a first end to a first end of said second rigid member, B) said third rigid member is flexibly connected at a first end to a second end of said second rigid member, and, 3) wherein, A) a second end of said first rigid member is connectable to the first securing mechanism of said central pole, and, B) a second end of said third rigid member is connectable to the second securing mechanism of said central pole.

2. The refuse bag holder according to claim 1, wherein during connection of a second end of said first rigid member to the first securing mechanism and during connection of a second end of the third rigid member, said first rigid member and said second rigid member are bowed, thereby causing said first rigid member and said second rigid member to press against the first securing mechanism and the second securing mechanism respectively.

3. The refuse bag holder according to claim 2, wherein said first securing member and said second securing member are substantially at right angles to each other.

4. The refuse bag holder according to claim 3, wherein, when said central pole is vertically secured in the ground, a first rigid linear member and a third linear member extend upward from a plane parallel to the ground.

5. The refuse bag holder according to claim 4, wherein said second rigid member is substantially linear.

6. The refuse bag holder according to claim 5, wherein said first and third rigid members are substantially linear.

7. The refuse bag holder according to claim 6, wherein said first and said second securing mechanism on said central pole include holes through said central pole.

8. The refuse bag holder according to claim 6, wherein said first and said second securing mechanism include pipes secured to said central pole.

9. The refuse bag holder according to claim 3, further including a container secured to said central pole, said container adapted to hold at least two empty refuse bags.

10. The refuse bag holder according to claim 9, wherein said container includes a dispenser adapted to hold refuse bag ties.

11. The refuse bag holder according to claim 3, wherein said central pole further includes a step bar configured to accept pressure from a user's foot for driving said central pole into the ground.

12. A refuse bag stand comprising:

a) a vertically mounted central pole; and, b) a removable loop securable to said central pole such that when said removable loop is secured to said central pole, said removable loop extends at an upward angle from said central pole wherein said removable loop includes first, second, third rigid members, and wherein:

1) said first rigid member is flexibly connected at a first end to a first end of said second rigid member;

2) said third rigid member is flexibly connected at a first end to a second end of said second rigid member;

3) a second end of said first rigid member is connectable to said central pole; and 4) a second end of said third rigid member is connectable to said central pole.

13. The refuse bag stand according to claim 12, where said central pole is adapted to be inserted into the ground and said central pole includes a handle at an upper end thereof.

14. The refuse bag stand according to claim 13, wherein said central pole further includes a step bar configured to accept pressure from a user's foot for driving said central pole into the ground.

15. The refuse bag stand according to claim 13, wherein said handle of said central pole is angled away from said removable loop.

16. A holder for a refuse bag comprising:

a) a central pole adapted to be manually inserted into the ground, said central pole having a first and second securing mechanism secured thereto; and, b) a loop secured to said first and second securing mechanism, said loop includes first, second, third rigid members having said first rigid member flexibly connected at a first end to a first end of said second rigid member, and said third rigid member flexibly connected at a first end to a second end of said rigid member, wherein said loop extends at an upward angle from a vertically mounted central pole.

17. The holder according to claim 16, wherein said first and said second securing mechanism on said central pole include holes through said pole.

* * * * *

UNITED STATES PATENT AND TRADEMARK OFFICE

CERTIFICATE OF CORRECTION

PATENT NO. : 6,648,386 B2
DATED : November 18, 2003
INVENTOR(S) : Rheinhardt

It is certified that error appears in the above-identified patent and that said Letters Patent is hereby corrected as shown below:

Title page,
Items [12] and [76], Inventor's name should read: -- Rheinhardt J. Beverly --

Signed and Sealed this

Twenty-seventh Day of April, 2004

JON W. DUDAS
*Acting Director of the United States Patent and Trademark Office*